US010589143B1

(12) United States Patent
Smythe

(10) Patent No.: US 10,589,143 B1
(45) Date of Patent: Mar. 17, 2020

(54) WEIGHT LIFTING SUPPORT SYSTEM

(71) Applicant: James Christopher Smythe, Fort Worth, TX (US)

(72) Inventor: James Christopher Smythe, Fort Worth, TX (US)

( * ) Notice: Subject to any disclaimer, the term of this patent is extended or adjusted under 35 U.S.C. 154(b) by 0 days.

(21) Appl. No.: 14/958,326

(22) Filed: Dec. 3, 2015

Related U.S. Application Data

(60) Provisional application No. 62/087,007, filed on Dec. 3, 2014.

(51) Int. Cl.
*A63B 21/00* (2006.01)
*A63B 21/072* (2006.01)
*A63B 21/065* (2006.01)
*A63B 23/04* (2006.01)

(52) U.S. Cl.
CPC ..... *A63B 21/4005* (2015.10); *A63B 21/065* (2013.01); *A63B 21/0724* (2013.01); *A63B 23/0405* (2013.01); *A63B 2023/0411* (2013.01)

(58) Field of Classification Search
CPC ..... A63B 21/4005; A63B 21/065; A63B 21/0724; A63B 21/0722; A63B 21/0726; A63B 21/0728; A63B 21/075; A63B 2023/0411; A63B 23/12; A63B 23/1281; A63B 23/04; A63B 23/0405; A63B 22/0015; A63B 22/0017; A63B 21/4001; A63B 21/0609; A63B 21/078; A63B 2023/4011; A63B 21/40; A63B 21/06–08; A63B 21/072–0783
USPC ..... 224/259–261, 265, 268
See application file for complete search history.

(56) References Cited

U.S. PATENT DOCUMENTS 148,744 A * 3/1874 Parent ..... E06C 7/187 182/8
2,477,432 A * 7/1949 Walsh ..... A45F 5/00 224/260
3,679,107 A * 7/1972 Perrine ..... A45F 3/14 224/201
4,213,605 A * 7/1980 McPeak ..... A63B 21/072 224/201
5,009,349 A * 4/1991 Eide ..... A45F 5/00 224/260
5,211,615 A * 5/1993 Sides ..... A63B 21/065 482/105
5,342,272 A * 8/1994 Pittroff ..... A63B 21/072 224/265
5,472,398 A * 12/1995 Silverman ..... A63B 21/4001 482/105
6,652,431 B1 * 11/2003 Mattox ..... A63B 21/0004 224/201
7,520,844 B1 * 4/2009 Flynn ..... A63B 21/065 482/105

(Continued)

OTHER PUBLICATIONS http://games.crossfit.com/workouts/regionals-indiviudal Crossfit, Inc Jul. 4, 2012.*

*Primary Examiner* — Nyca T Nguyen
(74) *Attorney, Agent, or Firm* — Eldredge Law Firm

(57) ABSTRACT

A weight lifting system includes a harness having a body with a thickness, the body having a contoured shape to fit around a shoulder of a user; an opening extending through the thickness of the body and sufficiently sized to receive a head of the user therethrough; and a cradle extending from a back surface of the harness and contoured to receive a weight bar within a channel.

4 Claims, 5 Drawing Sheets

(56) References Cited

U.S. PATENT DOCUMENTS

| | | | | |
|---|---|---|---|---|
| 8,496,143 | B1 * | 7/2013 | Joseph | A45F 3/14 224/201 |
| 8,657,166 | B1 * | 2/2014 | Harness | A45F 5/021 224/259 |
| 8,925,774 | B2 * | 1/2015 | Mori | A01D 34/902 224/259 |
| 2009/0014483 | A1 * | 1/2009 | Green | A41D 13/0007 224/157 |
| 2009/0170670 | A1 * | 7/2009 | Torres | A63B 21/4005 482/104 |
| 2014/0274593 | A1 * | 9/2014 | Kelly | A63B 21/0004 482/105 |
| 2014/0274594 | A1 * | 9/2014 | Medina | A63B 21/065 482/105 |

* cited by examiner

WEIGHT LIFTING SUPPORT SYSTEM

BACKGROUND

1. Field of the Invention

The present invention relates generally to weight lifting support systems.

2. Description of Related Art

Weight lifting systems are well known in the art and are effective means to assist individuals when lifting or training with weights. For example, FIG. 1 depicts a front view of a weight lifter 101 performing a standard squat lift exercise by carrying a weighted bar 103 on the shoulders 105 and FIG. 2 depicts a front view of a weight lifter 201 performing a standard dead lift exercise by carrying a weighted bar 203 via extended arms 205 and a closed grip 207. FIG. 3 depicts a back view of the lifter of FIG. 1 using a conventional weight lifting support system 301 to disperse the weight of the weighted bar 303 and to pad the lifter's shoulder 305. FIG. 4 depicts a magnified front view of a conventional system 401 used by the lifter of FIG. 2 to strengthen the lifter's grip 403 on the weighted bar 405 by transferring some of carried weight to lifter's wrist 407 via a strap 409 that wraps around the bar 405 and the wrist 407.

It should be understood that the primary purpose of conventional squat and dead lift exercises is to strengthen or enlarge the lower body musculature of the weight lifter. Therefore any discomfort or strength limitation in the lifter's upper body musculature while performing either of these lifts frustrates the primary purpose of the exercise. It is appreciated that systems 301 and 401 require extensive use of upper body musculature to support and stabilize the weighted bar.

A common disadvantage associated with systems 301 and 401 is that they require the lifter to engage upper body musculature to support and stabilize the weighted bar.

Another common disadvantage associated with systems 301 and 401 is that they can result in discomfort or injury to the lifter's upper body musculature. For example, system 301 only disperses the weight of the weighted bar 303 locally, rather than broadly, and system 401 merely transfers weight from the weighted bar 405 that is carried by the lifter's grip 403 to the lifter's wrist. Also, the cylindrical pad 305 of system 301 complicates stabilization efforts by making it easier for the weighted bar 303 to roll from the lifter's shoulders. It is understood and appreciated that the disadvantages discussed herein each increase the risk of discomfort or injury to the lifter.

Although great strides have been made in the area of weight lifting support systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
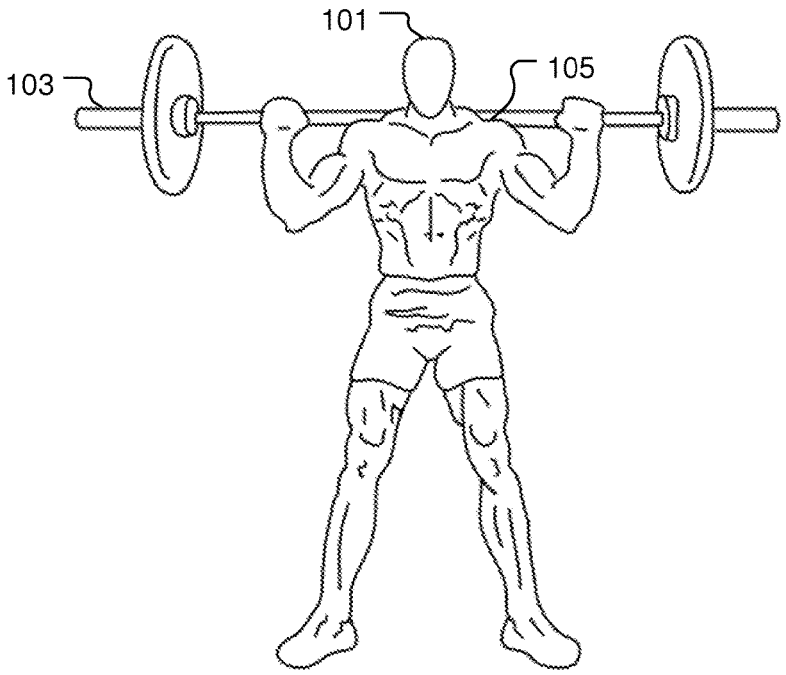
FIG. 1 (Prior Art)
FIG. 1 is a front view of a weight lifter performing an unassisted, conventional squat lift exercise.
Figure 2:
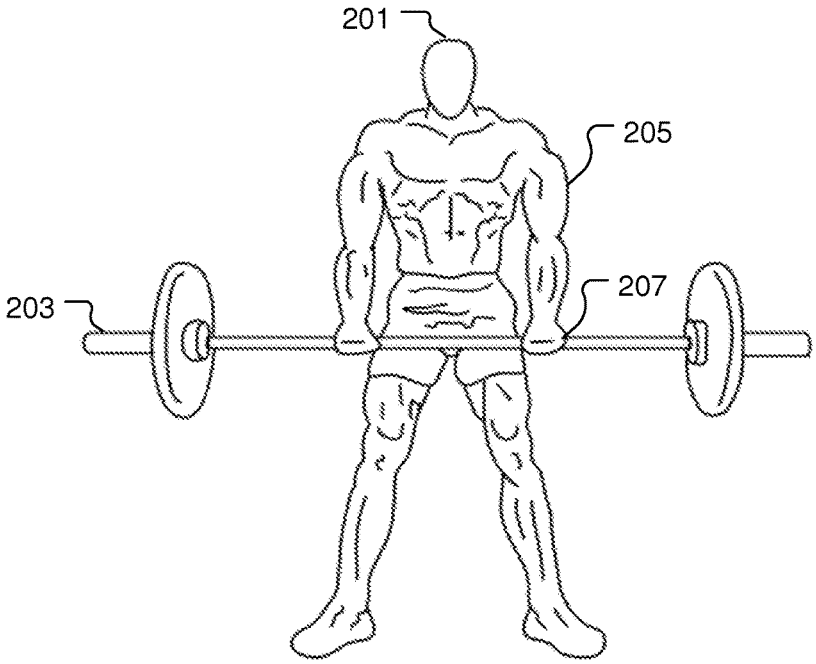
FIG. 2 (Prior Art)
FIG. 2 is a front view of a weight lifter performing an unassisted, conventional dead lift exercise.
Figure 3:
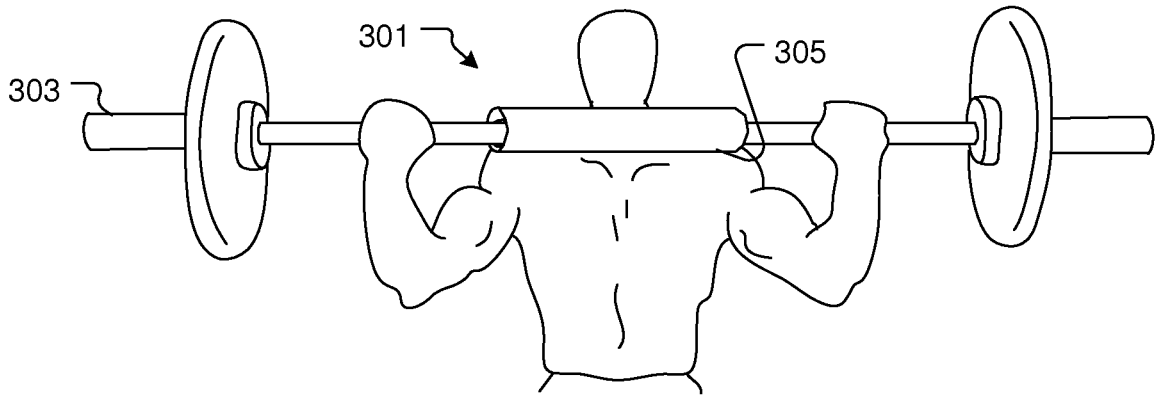
FIG. 3 (Prior Art)
FIG. 3 is a back view of the weight lifter of FIG. 1, performing a squat lift exercise while assisted by a conventional weight lifting support system.
Figure 4:
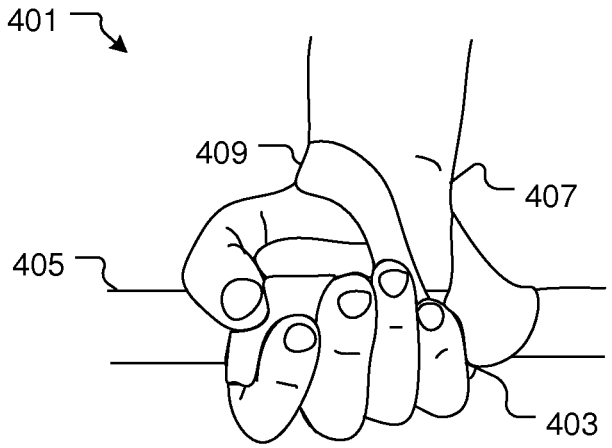
FIG. 4 (Prior Art)
FIG. 4 is a magnified front view of the weight lifter of FIG. 2, performing a dead lift exercise while assisted by a conventional weight lifting support system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional weight lifting support systems. Specifically, the system of the present application is configured to reduce engagement and discomfort of the upper body musculature of a weight lifter while performing squat lift or dead lift exercises with a weighted bar. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 5-8 depict various views of a weight lifting support system 501 in accordance with a preferred embodiment of the present application. It will be appreciated that the system 501 overcomes one or more of the above-listed problems commonly associated with the conventional weight lifting support systems.

In the contemplated embodiment, system 501 includes a harness 503 carried by a weight lifter's upper body 505 such that the weight is broadly dispersed across the upper body 505. The harness 503 includes a body having a thickness and an opening 700 extending through the thickness and sufficiently sized to receive the head of the user therethrough. The system 501 also includes one or more adjustable shoulder straps 507*a*, 507*b* removably attached to the body of the harness, two or more adjustable weight bearing straps 509*a*, 509*b* removably attached to the body of the harness, and a cradle 511 protruding from a back surface of the harness and contoured to receive a weighted bar 513 in a channel 702 as the user performs a squat lift exercise (see FIG. 6).

It is contemplated that the shoulder straps 507*a*, 507*b* and weight bearing straps 509*a*, 509*b* be detachable (see FIG. 7) from the harness 503. To assist the user in carrying the heavy bar 513, each bearing strap 509*a*, 509*b* is provided with a respective hook 515*a*, 515*b* contoured to receive the weighted bar 513 when performing a dead lift exercise.

One of the unique features believed characteristic of the present application is the use of system 501 to enable a weight lifter to perform a standard dead lift exercise with reduced discomfort or engagement of the upper body 505 musculature. Specifically, the weight bearing straps 509*a*, 509*b* hook around the weighted bar 513 by means of the support hooks 515*a*, 515*b* to simultaneously stabilize and transfer the weight of the bar 513 from the lifter's grip 517 to a broad area of the upper body 505. It will be appreciated that by reducing discomfort and engagement of upper body 505 musculature that the system 501 will facilitate safely strengthening or enlarging lower body 519 musculature via a dead lift exercise.

Figure 5:
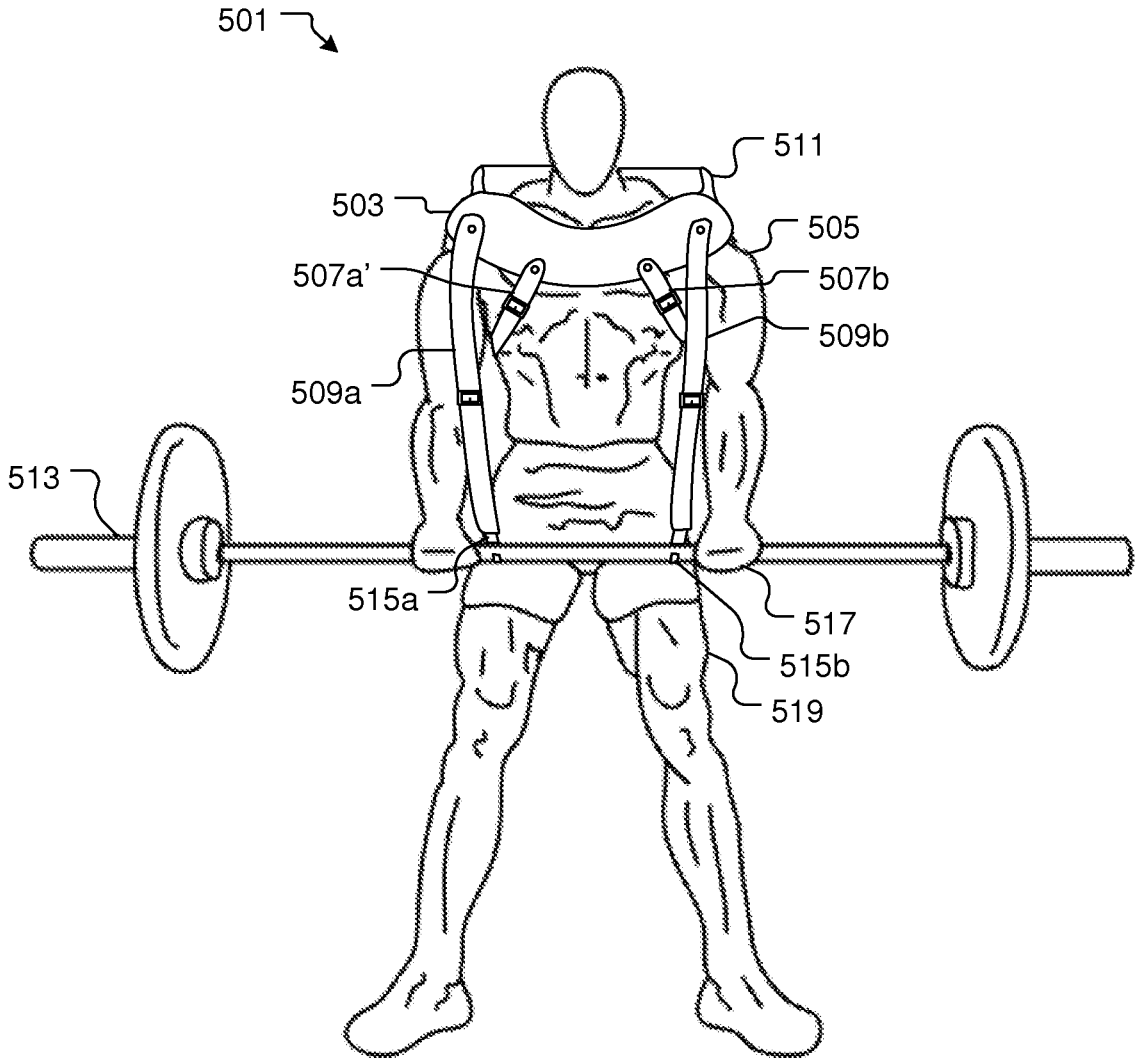
FIG. 5 is a front view of a weight lifter performing a dead lift exercise while assisted by a weight lifting support system in accordance with a preferred embodiment of the present application.
Figure 6:
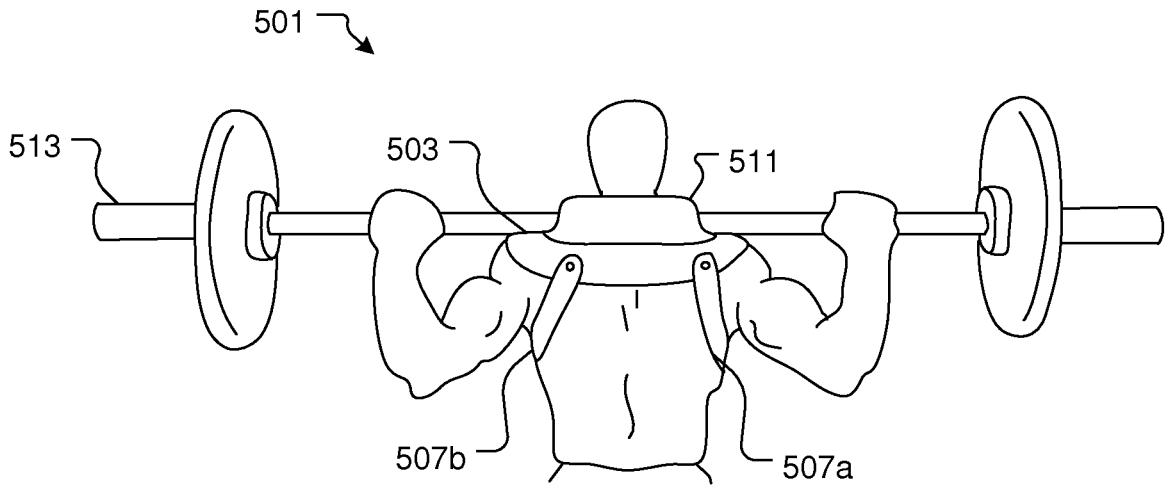
FIG. 6 is a back view of a weight lifter performing a squat lift exercise while assisted by the weight lifting support system of FIG. 5.

In one contemplated embodiment it is appreciated that the cradle 511 can be placed in front of the lifter's neck, rather than behind it as shown in FIG. 5. In another contemplated embodiment the position of the support cradles can be adjustable and removably attached to the harness 503.

Another of the unique features believed characteristic of the present application is the use of system 501 to enable a weight lifter to perform a standard squat lift exercise with minimal discomfort or engagement of the upper body musculature. Specifically, the support cradle 511 provides stabilization for the weighted bar and the harness 503 broadly disperses the weight across the upper body.

Figure 7:
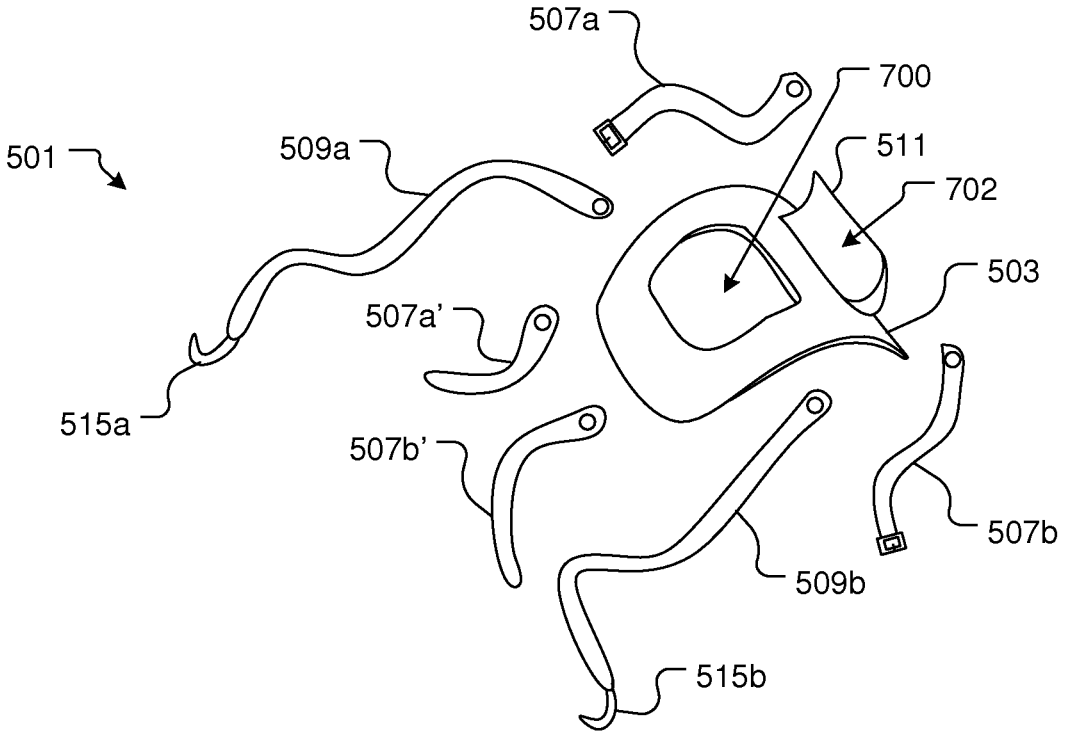
FIG. 7 is an exploded oblique view of the weight lifting support system of FIG. 5.
Figure 8:
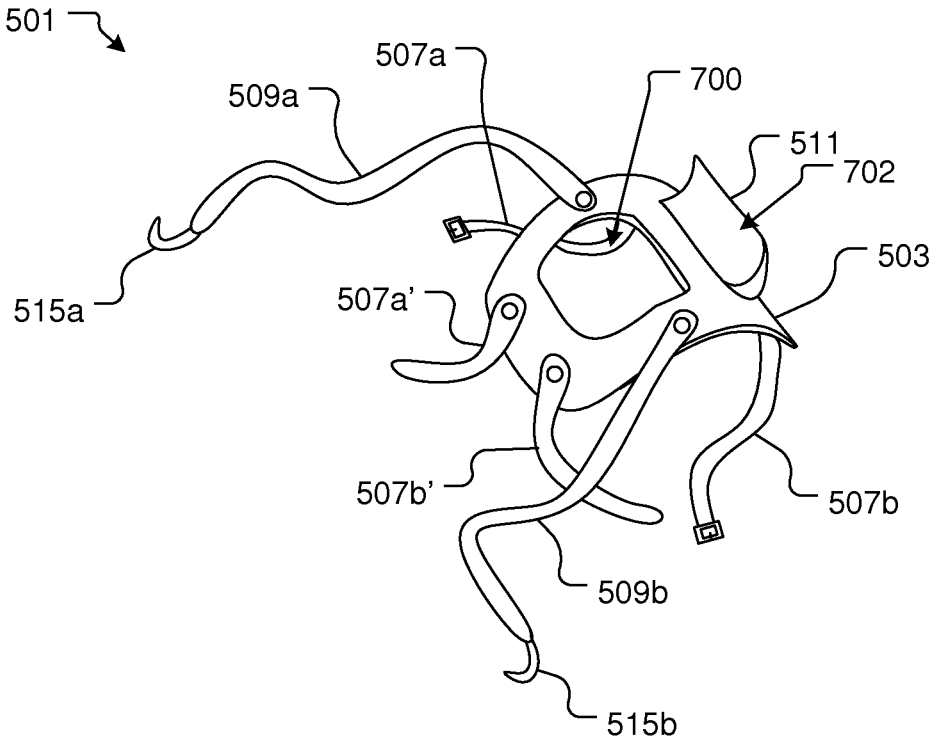
FIG. 8 is an assembled oblique view of the weight lifting support system of FIG. 5.

Referring now to FIGS. 7 and 8 an exploded view and an assembled view of the harness of system 501 is shown.

Another of the unique features believed characteristic of the present application is that straps are adjustable and detachable. It is appreciated that these features enable a weight lifter to safely secure the harness to the upper body (not shown), to remove excess elements such as the weight bearing straps during a squat lift exercise, or to facilitate storage.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A weight lifting system for a user with a head and shoulders and for lifting a weighted bar, comprising:

a harness having a body with a thickness, the body having a contoured shaped for fitting around the shoulders of the user, the body having a front surface;

an opening extending through the thickness of the body and sufficiently sized for receiving the head of the user therethrough;

a cradle extending from a back surface of the harness and contoured to receive the weighted bar within a channel of the cradle;

a first weight bearing strap having a first end that is secured directly to the front surface of the body of the harness;

a second weight bearing strap having a first end that is secured directly to the front surface of the body of the harness, the first weight bearing strap and the second weight bearing strap being separated from each other;

a first open hook attached to a second end of the first strap, the first open hook forming a contoured opening that is configured to engage with the weighted bar; and a second open hook attached to a second end of the second strap, the second open hook forming a contoured opening that is configured to engage with the weighted bar.

2. The system of claim 1, further comprising:

a first strap configured to engage with the front surface of the harness and the back surface of the harness.

3. The system of claim 2, wherein the first strap is adjustable.

4. The system of claim 2, wherein the first strap is removably attached to the harness.

* * * * *